US010385296B2

(12) United States Patent
Song et al.

(10) Patent No.: US 10,385,296 B2
(45) Date of Patent: Aug. 20, 2019

(54) METHODS FOR MAKING ENCAPSULATE-CONTAINING PRODUCT COMPOSITIONS

(71) Applicant: The Procter & Gamble Company, Cincinnati, OH (US)

(72) Inventors: Xinbei Song, Cincinnati, OH (US); Johan Smets, Lubbeek (BE); Pascale Claire Annick Vansteenwinckel, Weerde (BE); Jeffrey John Scheibel, Glendale, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

(21) Appl. No.: 15/460,279

(22) Filed: Mar. 16, 2017

(65) Prior Publication Data

US 2018/0265824 A1 Sep. 20, 2018

(51) Int. Cl.

| | |
|---|---|
| ***C11D 11/00*** | (2006.01) |
| ***C11D 17/00*** | (2006.01) |
| ***C11D 3/22*** | (2006.01) |
| ***C11D 3/37*** | (2006.01) |
| ***C11D 3/04*** | (2006.01) |
| ***C11D 3/16*** | (2006.01) |
| ***C11D 3/50*** | (2006.01) |
| ***C11D 7/06*** | (2006.01) |
| ***C11D 7/08*** | (2006.01) |
| ***C11D 7/22*** | (2006.01) |

(52) U.S. Cl.

CPC ..... *C11D 17/0013* (2013.01); *C11D 3/04* (2013.01); *C11D 3/042* (2013.01); *C11D 3/044* (2013.01); *C11D 3/166* (2013.01); *C11D 3/227* (2013.01); *C11D 3/3753* (2013.01); *C11D 3/3773* (2013.01); *C11D 3/505* (2013.01); *C11D 7/06* (2013.01); *C11D 7/08* (2013.01); *C11D 7/22* (2013.01); *C11D 17/0039* (2013.01)

(58) Field of Classification Search

None

See application file for complete search history.

(56) References Cited

U.S. PATENT DOCUMENTS

| | | | |
|---|---|---|---|
| 3,049,509 | A | 8/1962 | Hardy et al. |
| 5,281,355 | A | 1/1994 | Tsaur et al. |
| 6,355,263 | B1 | 3/2002 | Shuku et al. |
| 6,838,087 | B1 | 1/2005 | Day |

(Continued)

FOREIGN PATENT DOCUMENTS

| | | | |
|---|---|---|---|
| EP | 0079712 | B2 | 10/1993 |
| WO | WO9322417 | A1 | 11/1993 |

(Continued)

OTHER PUBLICATIONS

U.S. Appl. No. 15/460,272, filed Mar. 16, 2017, Xinbei Song.

(Continued)

*Primary Examiner* — Lorna M Douyon

(74) *Attorney, Agent, or Firm* — Andres E. Velarde; Gregory S. Darley-Emerson

(57) ABSTRACT

Methods relating to making product compositions that include encapsulates, borate compounds, and a cationic polysaccharide, where the encapsulates include polyvinyl alcohol polymer. Compositions made from such methods. Encapsulate slurries.

16 Claims, 3 Drawing Sheets

(56) References Cited

U.S. PATENT DOCUMENTS

| | | | | |
|---|---|---|---|---|
| 6,872,696 | B2 | 3/2005 | Becker et al. | |
| 6,949,498 | B2 | 9/2005 | Murphy et al. | |
| 7,169,741 | B2 | 1/2007 | Barry et al. | |
| 7,968,510 | B2 | 6/2011 | Smets et al. | |
| 8,853,142 | B2 | 10/2014 | Corominas et al. | |
| RE45,538 | E | 6/2015 | Smets et al. | |
| 9,162,085 | B2 | 10/2015 | Dihora et al. | |
| 9,186,642 | B2 | 11/2015 | Dihora et al. | |
| 2002/0010123 | A1 | 1/2002 | Schmiedel et al. | |
| 2004/0092425 | A1 | 5/2004 | Boutique et al. | |
| 2007/0202063 | A1 | 8/2007 | Dihora et al. | |
| 2009/0226529 | A1 | 9/2009 | Quellet et al. | |
| 2010/0029537 | A1* | 2/2010 | Dihora | A01N 25/26 510/276 |
| 2011/0021408 | A1* | 1/2011 | Meek | C11D 3/226 510/321 |
| 2011/0110997 | A1* | 5/2011 | Cunningham | A61K 8/11 424/401 |
| 2011/0268802 | A1* | 11/2011 | Dihora | A61K 8/11 424/489 |
| 2011/0269658 | A1 | 11/2011 | Dihora et al. | |
| 2013/0302392 | A1 | 11/2013 | Mistry et al. | |

FOREIGN PATENT DOCUMENTS

| | | | |
|---|---|---|---|
| WO | WO9948479 | A1 | 9/1999 |
| WO | WO0140430 | A1 | 6/2001 |
| WO | WO2011054389 | A1 | 5/2011 |
| WO | WO2011056934 | A1 | 5/2011 |
| WO | WO2011056935 | A1 | 5/2011 |
| WO | WO2012022034 | A1 | 2/2012 |
| WO | WO2012022736 | A1 | 2/2012 |
| WO | WO2012075293 | A2 | 6/2012 |
| WO | WO2013026657 | A1 | 2/2013 |

OTHER PUBLICATIONS

U.S. Appl. No. 15/460,277, filed Mar. 16, 2017, Xinbei Song.
U.S. Appl. No. 62/472,010, filed Mar. 16, 2017, Pierre Verstraete.
U.S. Appl. No. 62/472,012, filed Mar. 16, 2017, Hiroshi Oh.
14745 Search Report for PCT/US2018/019815, dated May 18, 2018, 13 pages.
14746 Search Report for PCT/US2018/019816, dated Jun. 7, 2018, 12 pages.
14747 Search Report for PCT/US2018/019817, dated Jun. 6, 2018, 14 pages.

* cited by examiner

METHODS FOR MAKING ENCAPSULATE-CONTAINING PRODUCT COMPOSITIONS

FIELD OF THE INVENTION

The present disclosure relates to methods of making product compositions that include encapsulates, borate compounds, and a cationic polysaccharide, where the encapsulates include polyvinyl alcohol polymer. The present disclosure further relates to compositions made from such methods. The present disclosure further relates to encapsulate slurries.

BACKGROUND OF THE INVENTION

Consumer product compositions, such as detergent compositions, comprising borate derivatives are known. Borate derivatives, such as sodium tetraborate, may promote, for example, enzyme stability in the consumer product compositions.

Consumer product compositions that include benefit agent encapsulates are also known. For example, such encapsulates may be core-shell encapsulates and have perfume raw materials in the core. Certain encapsulates may include polyvinyl alcohol, for example as part of the shell. The encapsulates may be provided to a product manufacturer as a concentrated composition, such as an encapsulate slurry.

However, it can be challenging to manufacture a liquid consumer product composition that has both a borate compound and encapsulates when the encapsulates include polyvinyl alcohol. Aggregation of the encapsulates may occur, resulting in poor product stability, poor performance, build-up on processing equipment, and/or unacceptable product aesthetics. Without wishing to be bound by theory, it is believed that the aggregation is a result from cross-linking due to hydrogen bonding that can occur between hydroxyl groups (—OH) of the borate derivatives and hydroxyl groups of the polyvinyl alcohol.

There is a need, then, for improved processes for manufacturing consumer product compositions that include borate derivatives and encapsulates, where the encapsulates include polyvinyl alcohol.

SUMMARY OF THE INVENTION

The present disclosure relates to methods of making product compositions that include encapsulates, borate compounds, and a cationic polysaccharide, where the encapsulates include polyvinyl alcohol polymer.

The present disclosure relates to a method of making a composition, where the method includes the steps of: providing a first composition and a second composition, where the first composition includes encapsulates, where the encapsulates include a polyvinyl alcohol polymer; where the second composition includes a borate compound; and where the first composition, the second composition, or both compositions include a cationic polysaccharide; and combining the first composition and the second composition to form a product composition.

The present disclosure relates to a slurry composition that includes: from about 10% to about 60%, by weight of the slurry composition, of encapsulates, where the encapsulates include a polyvinyl alcohol polymer; a cationic polysaccharide; and a liquid carrier.

BRIEF DESCRIPTION OF THE DRAWINGS

The figures herein are illustrative in nature and are not intended to be limiting.

DETAILED DESCRIPTION OF THE INVENTION

The present disclosure relates to improved processes for manufacturing product compositions, such as liquid detergent compositions, that include borate compounds and encapsulates that include polyvinyl alcohol.

As mentioned above, polyvinyl alcohol (i) and borate compounds (ii) can react according to the basic reaction shown below, creating a cross-linked species (iii).

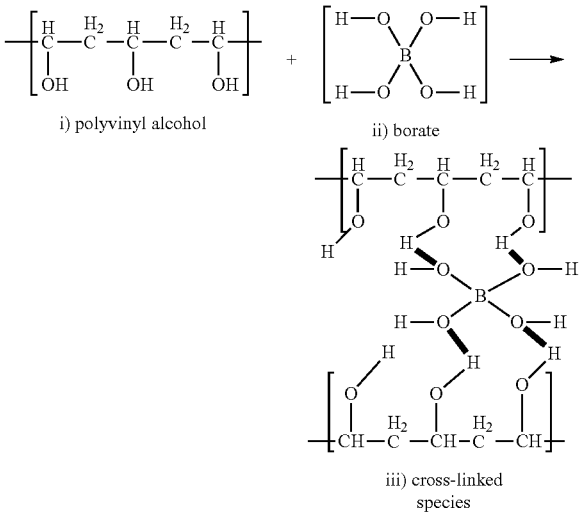

When encapsulates that include polyvinyl alcohol are combined with borate compounds, the cross-linking reaction can result in the aggregation of encapsulates, creating undesirable flocculation in the product.

Figure 1:
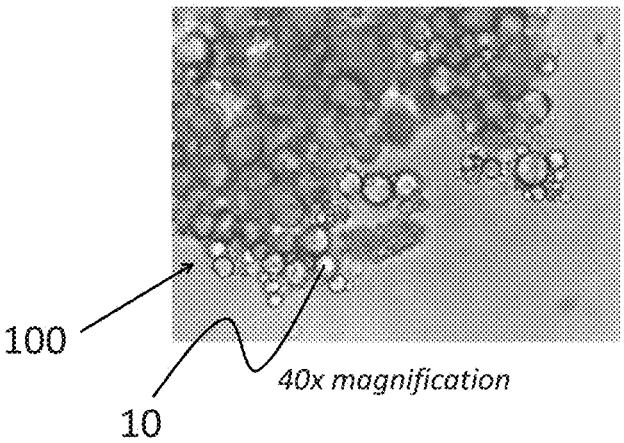
FIG. 1 shows a micrograph of a large aggregation of encapsulates in a detergent product.

For example, FIG. 1 shows a micrograph of encapsulate aggregation in a finished product, namely a laundry detergent. A slurry of encapsulates 10 was provided, where the encapsulates 10 include polyvinyl alcohol in their shells. When the slurry is added to a base detergent that includes a borate derivative, the encapsulates 10 tend to aggregate in the final product, forming aggregates 100.

It has been surprisingly found that adding a cationic polysaccharide at particular stages can be beneficial when formulating final product compositions. For example, it has been found that providing a cationic polysaccharide to an encapsulate-containing composition or to a borate-containing composition prior to the compositions being combined can result in product compositions that do not show significant aggregation of the encapsulates. For example, a cationic polysaccharide may be added to a first composition precursor, such as an encapsulate slurry, to form a first composition, which may then be combined with a second composition, where the second composition includes borate, thereby forming a product composition.

Figure 2:
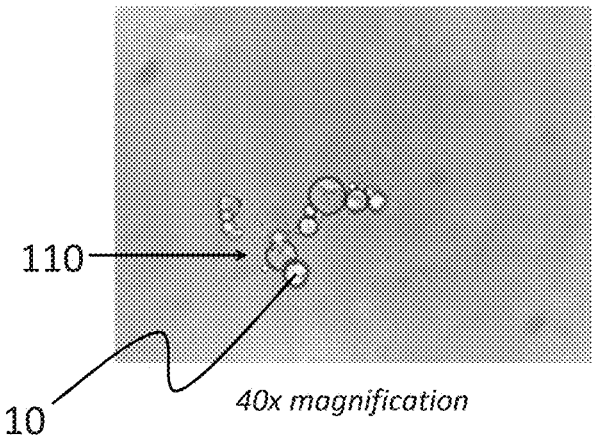
FIG. 2 shows a micrograph of encapsulates in a detergent product.

For example, FIG. 2 shows a micrograph of a finished product, a laundry detergent, made with a modified slurry. A slurry of polyvinyl-comprising encapsulates 10 was provided and added to a borate-containing base detergent. Although some small aggregates 110 of encapsulates 10 can be seen in the finished product, the aggregation is not significant or consumer-noticeable; in fact, many of the encapsulates 10 may be free-floating and are not aggregated.

Without wishing to be bound by theory, it is believed that that when added to a composition that contains polyvinyl alcohol or a borate compound, the cationic polysaccharide interacts with the hydroxyl (—OH) sites of the polyvinyl alcohol or borate compound, e.g., by forming hydrogen bonds. Because at least some of the hydroxyl sites of the polyvinyl alcohol or borate are occupied by the cationic polysaccharide, cross-linking between the polyvinyl alcohol and borate is reduced when the first and second compositions are combined, resulting in less aggregation of encapsulates. Less aggregation is typically desirable for performance and/or aesthetic reasons, as large aggregates may result, for example, in product instability.

Additionally, encapsulate slurries typically include high levels of inactive carriers, such as water and/or organic solvents, some of which may inhibit aggregate formation. However, such carriers typically do not act as active agents in the final product, taking up valuable formulation space without providing performance benefits. Cationic polysaccharides as described herein, on the other hand, may act as active agents in the final product thereby providing an additional advantage over certain organic solvents.

The methods and compositions of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition. As used herein "consumer product" means baby care, beauty care, fabric & home care, family care, feminine care, health care, snack and/or beverage products or devices intended to be used or consumed in the form in which it is sold, and not intended for subsequent commercial manufacture or modification. Such products include but are not limited to fine fragrances (e.g. perfumes, colognes eau de toilettes, after-shave lotions, pre-shave, face waters, tonics, and other fragrance-containing compositions for application directly to the skin), diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric conditioning (including softening), laundry detergency, laundry and rinse additive and/or care, hard surface cleaning and/or treatment, and other cleaning for consumer or institutional use; products and/or methods relating to bath tissue, facial tissue, paper handkerchiefs, and/or paper towels; tampons, feminine napkins; products and/or methods relating to oral care including toothpastes, tooth gels, tooth rinses, denture adhesives, tooth whitening; over-the-counter health care including cough and cold remedies, pain relievers, RX pharmaceuticals, pet health and nutrition, and water purification; processed food products intended primarily for consumption between customary meals or as a meal accompaniment (non-limiting examples include potato chips, tortilla chips, popcorn, pretzels, corn chips, cereal bars, vegetable chips or crisps, snack mixes, party mixes, multigrain chips, snack crackers, cheese snacks, pork rinds, corn snacks, pellet snacks, extruded snacks and bagel chips); and coffee.

As used herein, the term "cleaning composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various pouches, tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, the term "fabric care composition" includes, unless otherwise indicated, fabric softening compositions, fabric enhancing compositions, fabric freshening compositions and combinations thereof. The form of such compositions includes liquids, gels, beads, powders, flakes, and granules. Suitable forms also include unit dose articles that include such compositions, such as single- and multi-compartmented unit dose articles.

As used herein, the term "cationic polysaccharide" means a polysaccharide that carries a net cationic charge at a pH between 5 and 9; it may carry a cationic charge over the entire pH range, or a portion of the pH range. The cationic polysaccharide may carry a net cationic charge at the pH of the composition and/or during usage conditions, such as in a wash liquor, e.g., in a washing machine.

Unless otherwise noted, all component or composition levels are in reference to the active portion of that component or composition, and are exclusive of impurities, for example, residual solvents or by-products, which may be present in commercially available sources of such components or compositions.

For purposes of this application, castor oil, soybean oil, brominated vegetable oil, propan-2-yl tetradecanoate and mixtures thereof are not considered a perfume raw material when calculating perfume compositions/formulations. Thus, the amount of propan-2-yl tetradecanoate present is not used to make such calculations.

All temperatures herein are in degrees Celsius (° C.) unless otherwise indicated. Unless otherwise specified, all measurements herein are conducted at room temperature and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Method of Making a Composition

The present disclosure relates to methods of making a product composition. The product composition may be a consumer product composition. The product composition may be a cleaning composition. The product composition may be a fabric care composition, such as a laundry detergent.

Figure 3:
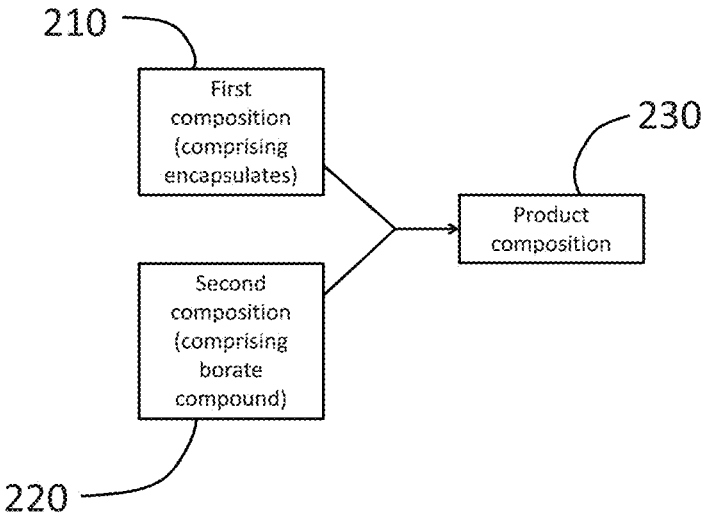
FIG. 3 shows a schematic representation of an encapsulate.

As illustrated in the flowchart of FIG. 3, the present disclosure relates to methods of making compositions. The method comprises the step of providing a first composition 210 and a second composition 220. The first composition 210 comprises encapsulates, and the encapsulates may comprise a polyvinyl alcohol polymer. The second composition 220 comprises a borate compound. The first composition 210, the second composition 220, or both compositions may comprise a cationic polysaccharide. Typically, the first composition 210 comprises the cationic polysaccharide, which may require less of the polysaccharide to provide the benefit and be more cost-effective. The method further comprises the step of combining the first and second compositions 210, 220 to form a product composition 230.

Figure 4:
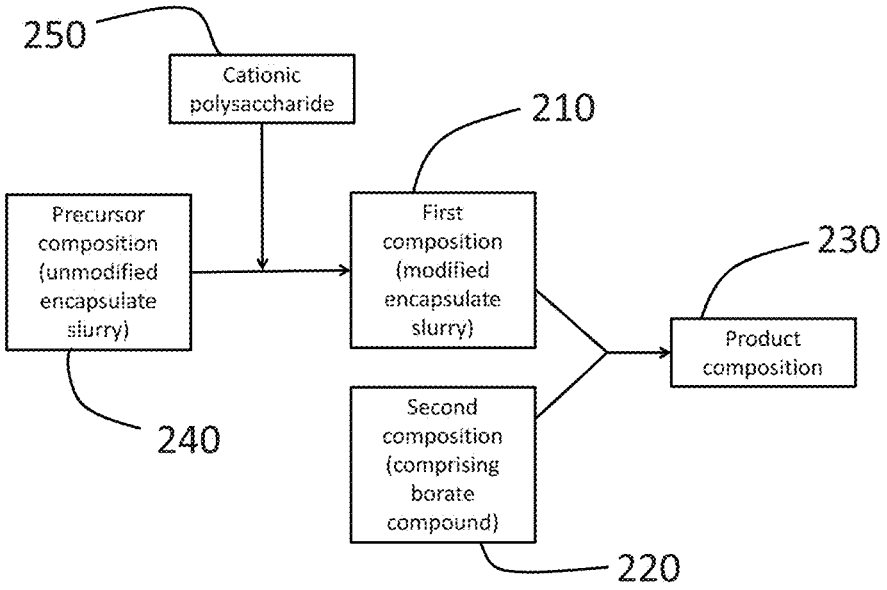
FIG. 4 shows a schematic representation of an encapsulate, where the encapsulate has a coating.

As shown in FIG. 4, a precursor composition 240 may be provided. The precursor composition 240 may be an unmodified encapsulate slurry. The cationic polysaccharide 250 may be added to the precursor composition 240 to form the first composition 210, where the first composition 210 is a modified encapsulate slurry. The first composition/modified slurry 210 may be combined with the second composition 220 to form the final product 230.

These elements are discussed in more detail below.

Encapsulates

Figure 5:
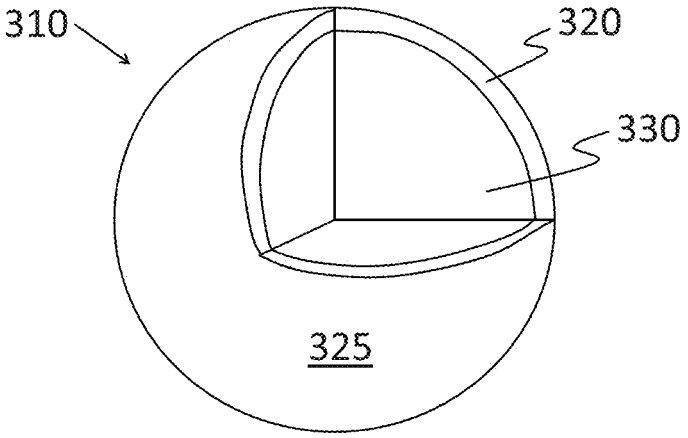
FIG. 5 shows a flowchart of steps for a method of making a product according to the present disclosure.
Figure 6:
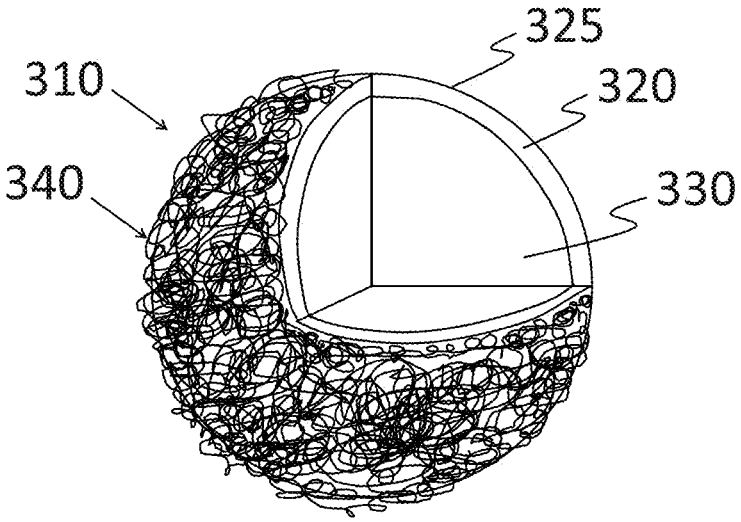
FIG. 6 shows a flowchart of steps for a method making a product according to the present disclosure.

The present disclosure relates to encapsulates. As schematically shown in FIG. 5, an encapsulate 310 may include a core 330 and a wall 320 at least partially surrounding the core 330. (As used herein, the terms "wall" and "shell" are used interchangeably with respect to encapsulates.) The core 330 may include a benefit agent, such as perfume. The wall 320 may include an outer surface 325. As schematically shown in FIG. 6, the outer surface 325 of the wall 320 may include a coating 340. The coating 340 may include an efficiency polymer. These elements are discussed in more detail below.

The wall of the encapsulates may include a wall material. The wall material may include a material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof.

The wall material may include a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof. The wall material may include a polyacrylate polymer. The wall may include from about 50% to about 100%, or from about 70% to about 100%, or from about 80% to about 100% of a polyacrylate polymer. The polyacrylate may include a polyacrylate cross linked polymer.

The wall material of the encapsulates may include a polymer derived from a material that comprises one or more multifunctional acrylate moieties. The multifunctional acrylate moiety may be selected from the group consisting of tri-functional acrylate, tetra-functional acrylate, penta-functional acrylate, hexa-functional acrylate, hepta-functional acrylate and mixtures thereof. The wall material may include a polyacrylate that comprises a moiety selected from the group consisting of an amine acrylate moiety, methacrylate moiety, a carboxylic acid acrylate moiety, carboxylic acid methacrylate moiety, and combinations thereof.

The wall material may include a material that comprises one or more multifunctional acrylate and/or methacrylate moieties. The ratio of material that comprises one or more multifunctional acrylate moieties to material that comprises one or more methacrylate moieties may be from about 999:1 to about 6:4, or from about 99:1 to about 8:1, or from about 99:1 to about 8.5:1. The multifunctional acrylate moiety may be selected from the group consisting of tri-functional acrylate, tetra-functional acrylate, penta-functional acrylate, hexa-functional acrylate, hepta-functional acrylate and mixtures thereof. The wall material may include a polyacrylate that comprises a moiety selected from the group consisting of an amine acrylate moiety, methacrylate moiety, a carboxylic acid acrylate moiety, carboxylic acid methacrylate moiety and combinations thereof.

The wall material may include an aminoplast. The aminoplast may include a polyurea, polyurethane, and/or polyureaurethane. The aminoplast may include an aminoplast copolymer, such as melamine-formaldehyde, urea-formaldehyde, cross-linked melamine formaldehyde, or mixtures thereof. The wall may include melamine formaldehyde, which may further include a coating as described below. The encapsulate may include a core that comprises perfume, and a wall that includes melamine formaldehyde and/or cross linked melamine formaldehyde. The encapsulate may include a core that comprises perfume, and a wall that comprises melamine formaldehyde and/or cross linked melamine formaldehyde, poly(acrylic acid) and poly(acrylic acid-co-butyl acrylate).

The core may include a benefit agent. Suitable benefit agent may be benefit agents that provide benefits to a surface, such as a fabric. The benefit agent may be selected from the group consisting of perfume raw materials, silicone oils, waxes, hydrocarbons, higher fatty acids, essential oils, lipids, skin coolants, vitamins, sunscreens, antioxidants, glycerine, catalysts, bleach particles, silicon dioxide particles, malodor reducing agents, odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. The benefit agent may include perfume raw materials.

The core may also comprise a partitioning modifier. Suitable partitioning modifiers may include vegetable oil, modified vegetable oil, propan-2-yl tetradecanoate and mixtures thereof. The modified vegetable oil may be esterified and/or brominated. The vegetable oil comprises castor oil and/or soy bean oil. The partitioning modifier may be propan-2-yl tetradecanoate. The partitioning modifier may be present in the core at a level, based on total core weight, of greater than 20%, or from greater than 20% to about 80%, or from greater than 20% to about 70%, or from greater than 20% to about 60%, or from about 30% to about 60%, or from about 30% to about 50%.

The encapsulates may have a volume weighted mean encapsulate size of from about 0.5 microns to about 100 microns, or from about 1 micron to about 60 microns.

The encapsulates may include a polyvinyl alcohol polymer. The polyvinyl alcohol polymer may be found in any location or region of the encapsulate that may interact with borate compounds in a finished product. For example, the polyvinyl alcohol polymer may be found in a core, a wall, an outer surface, and/or a coating of the encapsulates. The polyvinyl alcohol may be intentionally added to the encapsulates as an encapsulate component, such as a coating. The polyvinyl alcohol may be present in the encapsulates as an impurity that remains from the encapsulate-making process; for example, the polyvinyl alcohol may have been used to emulsify or suspend the main shell material as the encapsulates were manufactured.

The polyvinyl alcohol may be present in the encapsulates at a level of from about 0.5% to about 40%, or from about 0.8% to about 5%, by weight of the encapsulates. The polyvinyl alcohol polymer may be characterized by one or more of the following characteristics, as described below: hydrolysis degree, viscosity, degree of polymerization, weight average molecular weight, and/or number average molecular weight.

Suitable polyvinyl alcohol polymers may have a hydrolysis degree from about 55% to about 99%, or from about 75% to about 95%, or from about 85% to about 90%, or from about 87% to about 89%. Suitable polyvinyl alcohol polymers may have a viscosity of from about 40 cps to about 80 cps, or from about 45 cps to about 72 cps, or from about 45 cps to about 60 cps, or from about 45 cps to about 55 cps in 4% water solution at 20° C. Suitable polyvinyl alcohol polymers may be characterized by a degree of polymerization of from about 1500 to about 2500, or from about 1600 to about 2200, or from about 1600 to about 1900, or from about 1600 to about 1800. Suitable polyvinyl alcohol polymers may be characterized by a weight average molecular weight of from about 130,000 to about 204,000 Daltons, or from about 146,000 to about 186,000, or from about 146,000 to about 160,000, or from about 146,000 to about 155,000. Suitable polyvinyl alcohol polymers may be characterized by a number average molecular weight of from about 65,000 to about 110,000, or from about 70,000 to about 101,000, or from about 70,000 to about 90,000, or from about 70,000 to about 80,000 Daltons. The polyvinyl alcohol polymers found in the encapsulates of the present disclosure may have any suitable combination of these characteristics.

The encapsulate may comprise from 0.1% to 1.1%, by weight of the encapsulates, of polyvinyl alcohol. The polyvinyl alcohol may have at least one the following properties, or a mixture thereof: (i) a hydrolysis degree from 55% to 99%; (ii) a viscosity of from 40 mPa·s to 120 mPa·s in 4% water solution at 20° C.; (iii) a degree of polymerization of from 1,500 to 2,500; (iv) number average molecular weight of from 65,000 Da to 110,000 Da.

A deposition aid may at least partially coat the encapsulates, for example as a coating an outer surface of the wall of the encapsulates. The deposition aid may include a material selected from the group consisting of poly(meth) acrylate, poly(ethylene-maleic anhydride), polyamine, wax, polyvinylpyrrolidone, polyvinylpyrrolidone co-polymers, polyvinylpyrrolidone-ethyl acrylate, polyvinylpyrrolidone-vinyl acrylate, polyvinylpyrrolidone methylacrylate, polyvinylpyrrolidone/vinyl acetate, polyvinyl acetal, polyvinyl butyral, polysiloxane, poly(propylene maleic anhydride), maleic anhydride derivatives, co-polymers of maleic anhydride derivatives, polyvinyl alcohol, styrene-butadiene latex, gelatin, gum Arabic, carboxymethyl cellulose, carboxymethyl hydroxyethyl cellulose, hydroxyethyl cellulose, other modified celluloses, sodium alginate, chitosan, casein, pectin, modified starch, polyvinyl acetal, polyvinyl butyral, polyvinyl methyl ether/maleic anhydride, polyvinyl pyrrolidone and its copolymers, poly(vinyl pyrrolidone/methacrylamidopropyl trimethyl ammonium chloride), polyvinylpyrrolidone/vinyl acetate, polyvinyl pyrrolidone/dimethylaminoethyl methacrylate, polyvinyl amines, polyvinyl formamides, polyallyl amines and copolymers of polyvinyl amines, polyvinyl formamides, polyallyl amines and mixtures thereof. The coating may include the polyvinyl alcohol described above. The coating may be continuous or discontinuous on the outer surface of the wall.

The core/shell encapsulate may comprise an emulsifier, wherein the emulsifier is preferably selected from anionic emulsifiers, nonionic emulsifiers, cationic emulsifiers or mixtures thereof, preferably nonionic emulsifiers.

First Composition Comprising Encapsulates

The methods and compositions of the present disclosure relate to a first composition comprising encapsulates. The first composition may be an encapsulate slurry or a base detergent, typically a slurry. The first composition may comprise the cationic polysaccharide, as described below. The first composition may be substantially free of borate compounds.

The first composition may comprise from about 1%, or from about 5%, or from about 10%, or from about 20%, or from about 25%, or from about 30%, or from about 35%, to about 60%, or to about 50%, or to about 48%, by weight of the first composition, of encapsulates.

For ease of manufacturing and/or transport, encapsulates may be provided as a slurry composition having a relatively high concentration of encapsulates. However, it has been found that when such a slurry composition is combined with borate compounds in the absence of a cationic polysaccharide, undesirable aggregation of the encapsulates may occur, as described above. Therefore, the first composition may be obtained by providing a cationic polysaccharide to a precursor composition, such as a slurry composition, to form the first composition.

Put another way, the method described herein may include the step of providing a precursor composition, such as an unmodified slurry composition, that contains the encapsulates described herein. The precursor composition may include from about 20% to about 60%, by weight of the precursor/slurry composition, of the encapsulates. The slurry may include water, organic solvent, surfactant, antimicrobials, external structurant, or any other suitable materials including a cross-link inhibitor.

The method may further comprise the step of combining the precursor composition with a cationic polysaccharide to form the first composition. For example, an (unmodified) encapsulate slurry may be provided, and the cationic polysaccharide may be added to form a modified slurry. Suitable cationic polysaccharides are described below.

The precursor and/or first composition may include a limited number of ingredients, such as no more than seven, or no more than six, or no more than five ingredients. The ingredients may include any material suitable for inclusion in the final product composition. For example, the precursor/slurry may include water, organic solvent, surfactant, an external structurant, or combinations thereof.

The precursor and/or first composition may have a pH of from about 1 to about 7, or from about 2 to about 6, or from about 3 to about 6, or from about 4 to about 6. The pH is measured as a 10% dilution in deionized water (1 part slurry, 9 parts water). It is believed that maintaining a lower pH in the slurry results in less encapsulate aggregation in the final product.

The addition of the cationic polysaccharide to the precursor may occur at any suitable time. For example, the cationic polysaccharide may be added to the slurry by the slurry manufacturer prior to shipping the slurry to the product manufacturer. The product manufacturer may add the cationic polysaccharide to the slurry in advance of making the product composition. The product manufacturer may add the cationic polysaccharide to the slurry as part of an in-line step of the product manufacturing process. For example, the slurry may be combined with the cationic polysaccharide to form the first composition, and then the first composition may almost immediately be combined with the second composition.

The first composition may be a base product composition, such as a base detergent. The base detergent may comprise product adjuncts, as described below. The first composition being a base detergent may not be preferred, however, as a relatively greater amount of cationic polysaccharide may have to be added due to a base detergent being relatively dilute in terms of encapsulate concentration compared to an encapsulate slurry.

Second Composition Comprising a Borate Compound

The methods described herein further comprise the step of providing a second composition, where the second composition comprises a borate compound. The second composition may comprise the cationic polysaccharide, as described below. The first composition and the second composition may be combined, which may form a product composition.

As used in the present disclosure, a "borate compound" is a compound that comprises borate or that is capable of providing borate in solution. The borate compound may be any compound that is suitable for inclusion in a desired product composition. Borate compounds may be capable of providing different benefits, such as benefits related to pH buffering and/or enzyme stabilization. Borate compounds may include boric acid, boric acid derivatives, boronic acid, boronic acid derivatives, and combinations thereof.

Boric acid has the chemical formula $H_3BO_3$ (sometimes written as $B(OH)_3$). Boric acid derivatives include boron-containing compounds where at least a portion of the compound is present in solution as boric acid or a chemical equivalent thereof. Suitable boric acid derivatives include MEA-borate (i.e., monoethanolamine borate), borax, boric oxide, tetraborate decahydrate, tetraborate pentahydrate, alkali metal borates (such as sodium ortho-, meta- and pyroborate and sodium pentaborate), and mixtures thereof.

Boronic acid has the chemical formula $R—B(OH)_2$, where R is a non-hydroxyl substituent group. R may be selected from the group consisting of substituted or unsubstituted C6-C10 aryl groups and substituted or unsubstituted C1-C10 alkyl groups. R may be selected from the group consisting of substituted or unsubstituted C6 aryl groups and substituted or unsubstituted C1-C4 alkyl groups. The boronic acid may be selected from the group consisting of phenylboronic acid, ethylboronic acid, 3-nitrobenzeneboronic acid, and mixtures thereof.

The boronic acid may be a compound according to Formula I:

(I)

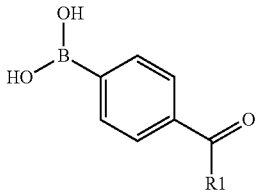

wherein R1 is selected from the group consisting of hydrogen, hydroxy, C1-C6 alkyl, substituted C1-C6 alkyl, C2-C6 alkenyl and substituted C2-C6 alkenyl. R1 may be a C1-C6 alkyl, in particular wherein $R^1$ is $CH_3$, $CH_3CH_2$ or $CH_3CH_2CH_2$, or wherein $R^1$ is hydrogen. The boronic acid may include 4-formyl-phenyl-boronic acid (4-FPBA).

The boronic acid may be selected from the group consisting of: thiophene-2 boronic acid, thiophene-3 boronic acid, acetamidophenyl boronic acid, benzofuran-2 boronic acid, naphtalene-1 boronic acid, naphtalene-2 boronic acid, 2-FPBA, 3-FBPA, 4-FPBA, 1-thianthrene boronic acid, 4-dibenzofuran boronic acid, 5-methylthiophene-2 boronic, acid, thionaphtrene boronic acid, furan-2 boronic acid, furan-3 boronic acid, 4,4 biphenyl-diborinic acid, 6-hydroxy-2-naphtalene, 4-(methylthio) phenyl boronic acid, 4 (trimethyl-silyl)phenyl boronic acid, 3-bromothiophene boronic acid, 4-methylthiophene boronic acid, 2-naphtyl boronic acid, 5-bromothiphene boronic acid, 5-chlorothiophene boronic acid, dimethylthiophene boronic acid, 2-bromophenyl boronic acid, 3-chlorophenyl boronic acid, 3-methoxy-2-thiophene, p-methyl-phenylethyl boronic acid, 2-thianthrene boronic acid, di-benzothiophene boronic acid, 4-carboxyphenyl boronic acid, 9-anthryl boronic acid, 3,5 dichlorophenyl boronic, acid, diphenyl boronic acidanhydride, o-chlorophenyl boronic acid, p-chlorophenyl boronic acid,m-bromophenyl boronic acid, p-bromophenyl boronic acid, p-flourophenyl boronic acid, p-tolyl boronic acid, o-tolyl boronic acid, octyl boronic acid, 1,3,5 trimethylphenyl boronic acid, 3-chloro-4-flourophenyl boronic acid, 3-aminophenyl boronic acid, 3,5-bis-(triflouromethyl)phenyl boronic acid, 2,4 dichlorophenyl boronic acid, 4-methoxyphenyl boronic acid, and combinations thereof.

The second composition may comprise from about 0.01% to about 10%, or from about 0.1% to about 5%, or from about 1% to about 3%, by weight of the second composition, of a borate compound.

The second composition may be a base product composition, such as a base detergent. The base detergent may comprise product adjuncts, as described below. The base detergent may comprise from about 5% to about 60%, by weight of the base detergent, of surfactant.

Cationic Polysaccharide

The first composition, the second composition, or both may comprise a cationic polysaccharide. Without wishing to be bound by theory, it is believed that when added to a composition that contains polyvinyl alcohol or a borate compound, the cationic polysaccharide interacts with the hydroxyl (—OH) sites of the polyvinyl alcohol or borate compound, e.g., by forming hydrogen bonds. Because at least some of the hydroxyl sites of the polyvinyl alcohol or borate are occupied by the polysaccharide, cross-linking between the polyvinyl alcohol and borate is reduced when the first and second compositions are combined, resulting in less aggregation of encapsulates.

The first composition, the second composition, or both compositions may comprise the cationic polysaccharide. The cationic polysaccharide may be present in only the first composition. The cationic polysaccharide may be present in only the second composition. The cationic polysaccharide may be added to a first composition precursor; for example, the cationic polysaccharide may be added to an encapsulate slurry composition to form a modified slurry. It has been found that adding a cationic polysaccharide to an encapsulate slurry more efficiently reduces encapsulate aggregation than adding the polysaccharide to a base detergent composition that includes a borate compound; in sum, a lower level of cationic polysaccharide is required.

The compositions herein may comprise from about 0.1% to about 20%, or from about 0.5% to about 10%, or from about 0.75% to about 4%, or from about 1% to about 2%, by weight of the composition, of the cationic polysaccharide. the first composition comprises the cationic polysaccharide. The first composition may comprise from about 0.1% to about 10%, preferably from about 0.5% to about 5%, by weight of the first composition, of the cationic polysaccharide.

Cationic polysaccharides include cationic cellulose derivatives, cationic guar gum derivatives, chitosan and derivatives, and cationic starches. The cationic polysaccharide may be a cationic cellulose derivative. The cationic polysaccharide may be a cationic cellulose derivative selected from the group consisting of cationic hydroxyethylcellulose, cationic hydroxypropylcellulose, and mixtures thereof, preferably cationic hydroxyethylcellulose. The cationic polysaccharide may be a cationic hydroxyethyl cellulose, preferably a hydroxyethyl cellulose derivatized with trimethyl ammonium substituted epoxide.

Preferred cationic celluloses for use herein include those which may or may not be hydrophobically-modified, including those having hydrophobic substituent groups, having a molecular weight of from 50,000 to 2,000,000, more preferably from 100,000 to 1,000,000, and most preferably from 200,000 to 800,000. These cationic materials have repeating substituted anhydroglucose units that correspond to the general Structural Formula I as follows:

Structural Formula I

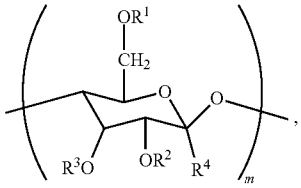

wherein:

a. m is an integer from 20 to 10,000 b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

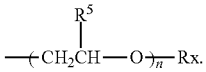

Preferably, $R^1$, $R^2$, $R^3$ are each independently selected from the group consisting of: H; and $C_1$-$C_4$ alkyl;

wherein:

n is an integer selected from 0 to 10 and

Rx is selected from the group consisting of: $R_5$;

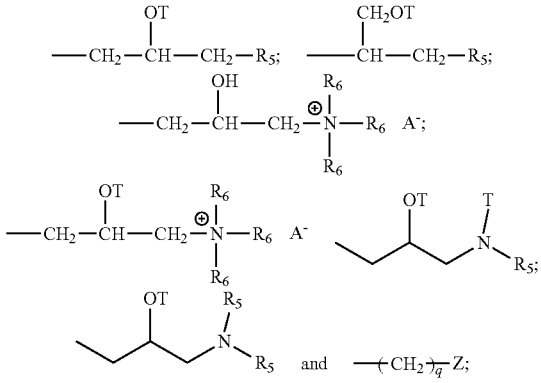

wherein at least one Rx in said polysaccharide has a structure selected from the group consisting of:

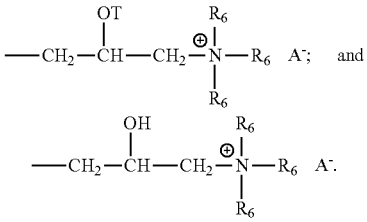

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group:

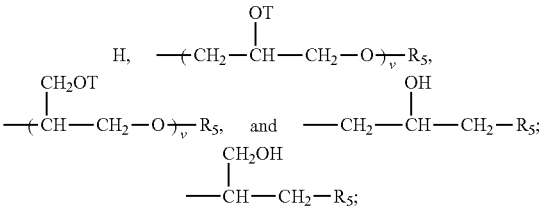

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

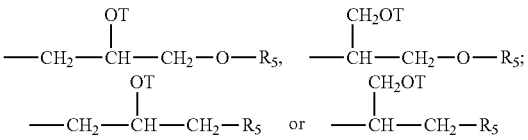

group in a chain, T is always an H.

Alkyl substitution on the anhydroglucose rings of the polymer may range from 0.01% to 5% per glucose unit, more preferably from 0.05% to 2% per glucose unit, of the polymeric material.

The cationic cellulose may be lightly cross-linked with a dialdehyde, such as glyoxyl, to prevent forming lumps, nodules or other agglomerations when added to water at ambient temperatures.

The cationic cellulose ethers of Structural Formula I likewise include those which are commercially available and further include materials which can be prepared by conventional chemical modification of commercially available materials. Commercially available cellulose ethers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK ™, all of which are marketed by Amerchol Corporation, Edgewater NJ; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater NJ . Cationic starches described by D. B. Solarek in Modified Starches, Properties and Uses published by CRC Press (1986) and in U.S. Pat. No. 7,135,451, col. 2, line 33-col. 4, line 67. Suitable cationic galactomannans include cationic guar gums or cationic locust bean gum. An example of a cationic guar gum is a quaternary ammonium derivative of Hydroxypropyl Guar such as those sold under the trade name: Jaguar C13 and Jaguar Excel available from Rhodia, Inc of Cranbury NJ and N-Hance by Aqualon, Wilmington, Del.

Product Composition

The present disclosure relates to methods of making product compositions. See the flowcharts of FIGS. 3 and 4. The product composition may be a consumer product composition. The product composition may be a cleaning composition. The product composition may be a fabric care composition. The cleaning composition may be in the form of a liquid or a gel. The cleaning composition may be in unit dose form.

The first and second compositions may be combined by any suitable method known to one of ordinary skill in the art. For example, the first and second compositions may be mixed with an in-line static mixer. The first and second composition may be mixed in a batch process, such as in a stirred tank.

The first and second compositions should be mixed at proportions suitable to give the desired levels of encapsulates and borate compound, respectively, in the product composition. The product composition may comprise from about 0.1% to about 5%, by weight of the product composition, of encapsulates. When the encapsulates include perfume raw materials, the product may comprise from about 0.1% to about 3%, or to about 2%, or to about 1%, or to about 0.75%, or to about 0.5%, by weight of the product composition, of perfume raw materials that are delivered by the encapsulates. The product composition may comprise from about 0.01% to about 4%, by weight of the product composition, of borate compound.

As described above, it is desired to minimize the aggregation of the encapsulates in the presence of borate compounds. The amount of aggregation may be determined using the AN212 method described below. The product composition may be characterized as having no more than 5 encapsulates per gram of product composition, or no more than 4 encapsulates per gram of product composition, or no more than 3 encapsulates per gram of product composition, or no more than 2.5 encapsulates per gram of product composition, as determined by the AN212 method described herein.

The product composition may be in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the composition is contained in at least one of the compartments. The compartments may be arranged in superposed orientation, i.e., one positioned on top of the other, where they may share a common wall. At least one compartment may be superposed on another compartment. Alternatively, the compartments may be positioned in a side-by-side orientation, i.e., one orientated next to the other. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

The unit dose form may comprise water-soluble film that forms the compartment and encapsulates the detergent composition. Preferred film materials are polymeric materials; for example, the water-soluble film may comprise polyvinyl alcohol. The film material can, for example, be obtained by casting, blow-moulding, extrusion, or blown extrusion of the polymeric material, as known in the art. Suitable films are those supplied by Monosol (Merrillville, Ind., USA) under the trade references M8630, M8900, M8779, M9467, and M8310, and PVA films of corresponding solubility and deformability characteristics. The film and/or composition contained therein may comprise an aversive agent, such as BITREX™.

When the product composition is a liquid, the fabric care composition typically comprises water. The composition may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

The first, second, and/or product compositions may include a surfactant system. The compositions may include from about 5% to about 60%, by weight of the composition, of the surfactant system. The composition may include from about 20%, or from about 25%, or from about 30%, or from about 35%, or from about 40%, to about 60%, or to about 55%, or to about 50%, or to about 45%, by weight of the composition, of the surfactant system. The composition may include from about 35% to about 50%, or from about 40% to about 45%, by weight of the composition, of a surfactant system. The product composition may comprise from about 5 wt % to about 60 wt % of a surfactant system. The first composition and/or the second composition may be a base detergent comprising from about 5 wt % to about 60 wt % of surfactant system.

The surfactant system may include any surfactant suitable for the intended purpose of the detergent composition. The surfactant system may comprise a detersive surfactant selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material.

The surfactant system may include anionic surfactant. The anionic surfactant may include alkoxylated sulfate surfactant, which may include alkyl ethoxylated sulfate. The anionic surfactant may include anionic sulphonate surfactant, which may include alkyl benzene sulphonate, including linear alkyl benzene sulphonate.

The surfactant system may include nonionic surfactant. These can include, for example, alkoxylated fatty alcohols and amine oxide surfactants. In some examples, the surfactant system may contain an ethoxylated nonionic surfactant.

The first, second, and/or product compositions may include any other suitable product adjuncts. Such adjuncts may be selected, for example, to provide performance benefits, stability benefits, and/or aesthetic benefits. Suitable product adjuncts may include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 E020 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, solvents, antimicrobial agents and/or preservatives, neutralizers and/or pH adjusting agents, processing aids, opacifiers, pearlescent agents, pigments, or mixtures thereof. A few of these product adjuncts are discussed in more detail below.

The compositions may include an external structuring system. The structuring system may be used to provide sufficient viscosity to the composition in order to provide, for example, suitable pour viscosity, phase stability, and/or suspension capabilities.

The compositions of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear (0.05 $s^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

The compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the composition. Suitable crystallizable glycerides include hydrogenated castor oil or "HCO" or derivatives thereof, provided that it is capable of crystallizing in the liquid compositions described herein.

The compositions may comprise from about 0.01% to 5% by weight of a naturally derived and/or synthetic polymeric structurant. Suitable naturally derived polymeric structurants include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable synthetic polymeric structurants include: polycarboxylates, polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

The compositions may include enzymes. Enzymes may be included in the compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the compositions described herein include hemicellulases, gluco-amylases, xylanases, esterases, cutinases, pectinases, keratanases, reductases, oxidases, phenoloxidases, lipoxygenases, lignin-ases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

The present disclosure further relates to product compositions made according to the methods described herein. For example, the present disclosure relates to product compositions made according to the following steps: providing a first composition comprising encapsulates, where the first composition comprises no more than about 15 wt % of the encapsulates, and where the encapsulates comprise polyvinyl alcohol polymer; and combining the first composition with a second composition comprising a borate compound, thereby forming a product composition. The first composition may be made by providing a slurry that comprises from about 20 wt % to about 60 wt % of the encapsulates, by weight of the slurry, and combining the slurry with a cationic polysaccharide to form the first composition. The product composition may include from about 5 wt % to about 60 wt % of surfactant. The product composition may be characterized as having no more than 5 encapsulates per gram of product composition, or no more than 4 encapsulates per gram of product composition, or no more than 3 encapsulates per gram of product composition, or no more than 2.5 encapsulates per gram of product composition, as determined by the AN212 method described herein.

Slurry Composition

The present disclosure further relates to a slurry composition. The slurry compositions of the present disclosure may be useful premixes, and may have a limited number of ingredients. For example, the slurry composition may have no more than seven ingredients, or no more than six ingredients, or no more than five ingredients. Typically, the ingredients are compatible with, or even useful in, the final product composition.

The slurry composition may have the same characteristics as the first composition as described above, for example the modified slurry described above. The slurry composition may comprise: from about 10% to about 60%, by weight of the slurry composition, of encapsulates, where the encapsulates comprise a polyvinyl alcohol polymer; a cationic polysaccharide; and a liquid carrier.

Suitable encapsulates are described above. The slurry composition may comprise encapsulates that comprise a core and a shell at least partially surrounding the core. The core may comprise a benefit agent, as described above, such as perfume raw materials. The shell may comprise least a portion of the polyvinyl alcohol polymer.

The shell may comprise any of the shell materials described above. The shell may comprise a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof. The shell material may comprise a polyacrylate.

Suitable cationic polysaccharides are described above. The cationic polysaccharide may be a cationic cellulose derivative. The cationic polysaccharide may be a cationic cellulose derivative selected from the group consisting of cationic hydroxyethylcellulose, cationic hydroxypropylcellulose, and mixtures thereof, preferably cationic hydroxyethylcellulose. The cationic polysaccharide may be a cationic hydroxyethyl cellulose, preferably a hydroxyethyl cellulose derivatized with trimethyl ammonium substituted epoxide.

The slurry may comprise from about 0.1% to about 10%, preferably from about 0.5% to about 5%, by weight of the first composition, of the cationic polysaccharide.

The liquid carrier of the water may comprise water and/or an organic solvent. The liquid carrier may be water.

Methods of Use

The present disclosure relates to a method of pretreating or treating a surface, such as a fabric, where the method includes the step of contacting the surface (e.g., fabric) with the product composition described herein. The contacting step may occur in the presence of water, where the water and the product composition form a wash liquor. The contacting may occur during a washing step, and water may be added before, during, or after the contacting step to form the wash liquor.

The washing step may be followed by a rinsing step. During the rinsing step, the fabric may be contacted with a fabric softening composition, wherein said fabric softening composition comprises a fabric softening active. The fabric softening active of the methods described herein may comprise a quaternary ammonium compound, silicone, fatty acids or esters, sugars, fatty alcohols, alkoxylated fatty alcohols, polyglycerol esters, oily sugar derivatives, wax emulsions, fatty acid glycerides, or mixtures thereof. Suitable commercially available fabric softeners may also be used, such those sold under the brand names DOWNY®, LENOR® (both available from The Procter & Gamble Company), and SNUGGLE® (available from The Sun Products Corporation). The step of contacting the fabric with a fabric softening composition may occur in the presence of water, for example during a rinse cycle of an automatic washing machine.

Any suitable washing machine may be used, for example, a top-loading or front-loading automatic washing machine. Those skilled in the art will recognize suitable machines for the relevant wash operation. The compositions of the present disclosure may be used in combination with other compositions, such as fabric additives, fabric softeners, rinse aids, and the like.

Additionally, the product compositions of the present disclosure may be used in known methods where a surface is treated/washed by hand.

Combinations

Specifically contemplated combinations of the disclosure are herein described in the following lettered paragraphs.

These combinations are intended to be illustrative in nature and are not intended to be limiting.

A. A method of making a composition, the method comprising the steps of: (a) providing a first composition and a second composition, wherein the first composition comprises encapsulates, wherein the encapsulates comprise a polyvinyl alcohol polymer; wherein the second composition comprises a borate compound; and wherein the first composition, the second composition, or both compositions comprises a cationic polysaccharide; (b) combining the first composition and the second composition to form a product composition.

B. A method according to paragraph A, wherein the encapsulates are encapsulates that comprise a core and a shell at least partially surrounding the core, wherein the core comprises a benefit agent, and wherein the shell comprises at least a portion of the polyvinyl alcohol polymer.

C. A method according to paragraphs B, wherein the benefit agent of the core comprises perfume raw materials.

D. A method according to any of paragraphs B-C, wherein the core further comprises a partitioning modifier.

E. A method according to any of paragraphs B-D, wherein the shell comprises a shell material selected from the group consisting of polyethylenes; polyamides; polystyrenes; polyisoprenes; polycarbonates; polyesters; polyacrylates; acrylics; aminoplasts; polyolefins; polysaccharides; gelatin; shellac; epoxy resins; vinyl polymers; water insoluble inorganics; silicone; and mixtures thereof.

F. A method according to any of paragraphs B-E, wherein the shell comprises a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

G. A method according to any of paragraphs B-F, wherein the shell material comprises a polyacrylate.

H. A method according to any of paragraphs A-G, wherein the first composition is an encapsulate slurry comprising from about 10% to about 60%, by weight of the first composition, of encapsulates.

I. A method according to any of paragraphs A-H, wherein the borate compound is selected from the group consisting of boric acid, boric acid derivatives, and combinations thereof.

J. A method according to any of paragraphs A-I, wherein the borate compound is present in the product composition at a level of about 0.1 wt % to about 10 wt %, by weight of the product composition.

K. A method according to any of paragraphs A-J, wherein the first composition comprises the cationic polysaccharide.

L. A method according to paragraph K, wherein the first composition comprises from about 0.1% to about 10%, preferably from about 0.5% to about 5%, by weight of the first composition, of the cationic polysaccharide.

M. A method according to any of paragraphs K-L, wherein the method further comprises the step of providing the cationic polysaccharide to a precursor composition to form the first composition.

N. A method according to any of paragraphs A-M, wherein the cationic polysaccharide is a cationic cellulose derivative.

O. A method according to paragraph N, wherein the cationic cellulose derivative is selected from the group consisting of cationic hydroxyethylcellulose, cationic hydroxypropylcellulose, and mixtures thereof, preferably cationic hydroxyethylcellulose.

P. A method according to paragraph O, wherein the cationic hydroxyethylcellulose comprises hydroxyethyl cellulose derivatized with trimethyl ammonium substituted epoxide.

Q. The method according to any of paragraphs A-P, wherein the cationic polysaccharide comprises repeating substituted anhydroglucose units that correspond to the general Structural Formula I as follows:

Structural Formula I

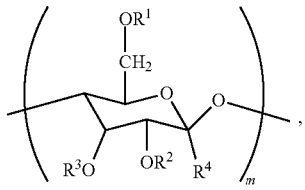

wherein:

a. m is an integer from 20 to 10,000; and b. each R4 is H, and c. $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

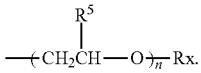

R. A method according to any of paragraphs A-Q, wherein the cationic polysaccharide is characterized by a weight average molecular weight of from greater than 100,000 to 2,000,000, preferably from greater than 100,000 to 1,000,000, more preferably from 200,000 to 800,000.

S. A method according to any of paragraphs A-R, wherein the product composition comprises from about 0.01 wt % to about 5 wt % of the encapsulates.

T. A method according to any of paragraphs A-S, wherein the product composition further comprises an enzyme.

U. A method according to any of paragraphs A-T, wherein the product composition further comprises an external structurant.

V. A method according to any of paragraphs A-U, wherein the product composition comprises from about 5 wt % to about 60 wt % of surfactant.

W. A method according to any of paragraphs A-V, wherein the product composition comprises no more than 5 encapsulates per gram of product composition, as determined by the AN212 method described herein.

X. A method according to any of paragraphs A-W, wherein either the first composition or the second composition is a base detergent comprising from about 5 wt % to about 75 wt % of a surfactant system.

Y. A product composition made according to the method of any of paragraphs A-X.

Z. A product composition according to paragraph Y, wherein the product composition comprises from about 5 wt % to about 60 wt % of a surfactant system.

AA. A slurry composition comprising: from about 10% to about 60%, by weight of the slurry composition, of encapsulates, wherein the encapsulates comprise a polyvinyl alcohol polymer; a cationic polysaccharide; and a liquid carrier.

BB. A slurry composition according to paragraph AA, wherein the encapsulates are encapsulates that comprise a core and a shell at least partially surrounding the core, wherein the core comprises a benefit agent, and wherein the shell comprises at least a portion of the polyvinyl alcohol polymer.

CC. A slurry composition according to paragraph BB, wherein the benefit agent of the core comprises perfume raw materials.

DD. A slurry composition according to any of paragraphs BB-CC, wherein the shell comprises a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

EE. A slurry composition according to any of paragraphs BB-DD, wherein the shell material comprises a polyacrylate.

FF. A slurry composition according to any of paragraphs BB-EE, wherein the cationic polysaccharide is a cationic cellulose derivative.

GG. A slurry composition according to paragraph FF, wherein the cationic cellulose derivative is selected from the group consisting of cationic hydroxyethylcellulose, cationic hydroxypropylcellulose, and mixtures thereof, preferably cationic hydroxyethylcellulose.

HH. A slurry composition according to paragraph GG, wherein the cationic hydroxyethylcellulose comprises hydroxyethyl cellulose derivatized with trimethyl ammonium substituted epoxide.

II. An encapsulate slurry according to any of paragraphs BB-HH, wherein the liquid carrier comprises water.

JJ. An encapsulate slurry according to any of paragraphs AA-II, wherein the slurry contains no more than seven ingredients.

KK. An encapsulate slurry according to any of paragraphs AA-JJ, where the slurry comprises about 0.1% to about 10%, by weight of the slurry, of the cationic polysaccharide.

Test Methods

Method for Determining Volume Weighted Mean Encapsulate Size

Encapsulate size is measured using an Accusizer 780A, made by Particle Sizing Systems, Santa Barbara Calif. The instrument is calibrated from 0 to 300 μm using Duke particle size standards. Samples for encapsulate size evaluation are prepared by diluting about 1 g emulsion, if the volume weighted mean encapsulate size of the emulsion is to be determined, or 1 g of capsule slurry, if the finished capsule volume weighted mean encapsulate size is to be determined, in about 5 g of de-ionized water and further diluting about 1 g of this solution in about 25 g of water.

About 1 g of the most dilute sample is added to the Accusizer and the testing initiated, using the autodilution feature. The Accusizer should be reading in excess of 9200 counts/second. If the counts are less than 9200 additional sample should be added. The accusizer will dilute the test sample until 9200 counts/second and initiate the evaluation. After 2 minutes of testing the Accusizer will display the results, including volume-weighted median size.

The broadness index can be calculated by determining the encapsulate size at which 95% of the cumulative encapsulate volume is exceeded (95% size), the encapsulate size at which 5% of the cumulative encapsulate volume is exceeded (5% size), and the median volume-weighted encapsulate size (50% size-50% of the encapsulate volume both above and below this size). Broadness Index (5)=((95% size)−(5% size)/50% size).

Method for Determining Number of Particles ("AN212 Method")

The following method ("AN212 method") is used to determine the amount of particles of a certain minimum size per gram of a composition sample. The particles counted may be aggregates or any other particles found in the composition. In sum, a sample is weighed and dispensed onto a 212 micron sieve; the particles remaining on the sieve are counted.

Sample Preparation:

When working with an encapsulate slurry composition, the slurry is filtered prior to using the method below. To filter the slurry, homogenize the slurry sample by gentle shaking or mixing. The homogenized sample is then filtered through a 425 micron sieve (available from VWR; catalog #57334-274) prior to use with the method.

Cleaning the Sieve(s):

Clean/rinse the sieve(s) thoroughly with tap water by adding a hose to the tap and squeezing the hose at the end to generate a strong jet. The sieve is first cleaned in an upside-down position, so that any aggregates that remain do not get pushed through the mesh. After the first portion of washing when the sieve is in an upside-down position, the sieve is flipped several times during the cleaning/rinsing process. Dry the sieve first with a towel or with paper, and then dry the mesh with pressurized air.

Test Method:

1. Clean and dry a 212 micron sieve (available from VWF; catalog #57334-282) according to the above instructions. Record the weight of the sieve.

2. Using a syringe, place a sample weighing about 20 g of the encapsulate-containing composition onto the sieve; the composition is spread in a line over the sieve. Record the weight of the sieve+composition and determine the amount of composition sample added by subtracting the weight of the sieve.

3. Tap the sieve lightly to allow the composition to flow through the sieve. Light air or nitrogen may be blown over the sample to help alleviate air bubbles trapped on the sieve.

4. After the composition sample has passed through the sieve, count the number of particles remaining on the sieve. (Take care to count the particles, as distinguished from air bubbles; additional air/nitrogen can be used if there is a question.) Record the number of encapsulates. Repeat counting three times.

5. Repeat steps 1-4 at less three more times, so that a total of at least four composition samples have been tested.

6. For each sample, divide the average number of particles counted by sample weight used to get particle number per gram of sample.

7. Average the particle numbers per gram of sample to provide the final particle number per gram composition value.

8. Clean the sieve(s) immediately after use.

Method for Determining Encapsulate Size Distribution

The average size of encapsulates, aggregates, and other particles are determined by the measuring capabilities of a Lasentec FBRM Encapsulate Size and Distribution Analyzer, model PI-14/206 (Mettler Toledo, Columbus, Ohio). Focused Beam Reflectance Measurement (FBRM) technology is a probe-based instrument that is inserted directly into processes to track changing encapsulate size and count in real time at full process concentrations. Encapsulates, encapsulate structures (such as aggregates) and droplets are monitored continuously, as experimental conditions vary, providing the evidence required delivering consistent encapsulates with the required attributes. The software and instrument is set up as follows for data gathering and analysis.

Software Version and Instrument Setting:

The corresponding software and data analysis package are version 6.0, build 16.

Blank Measuring:

In "Meas. Config" mode, press the "Measure" button. Rinse the probe with DI water to remove any background debris. After rinsing, measure a DI water sample and ensure the encapsulate counts are <150 per channel (most will be 0).

Sample Measuring:

After measuring the blank, the samples are ready to be measured. Remove the DI water sample and dry the probe with a clean paper towel. Prepare your sample by weighing 75 g into an appropriate container and placing under the probe. Turn on the impeller and set to 400 RPM. After 30 seconds of equilibration time, note all the encapsulate counts for every channel. To switch to next sample, turn off impeller and remove previous sample. Fill small container with warm water and place under probe and turn on impeller to clean the probe. Remove the warm water and rinse with DI water and dry probe with a clean paper towel. The next sample is taken by repeating the instructions above.

EXAMPLES

Example 1

Preparation of a Modified Encapsulate Slurry

An encapsulate slurry may be prepared according to the following procedure.

An oil solution, consisting of 150 g Fragrance Oil, 0.6 g DuPont Vazo-52, and 0.4 g DuPont Vazo-67, is added to a 35° C. temperature controlled steel jacketed reactor, with mixing at 1000 rpm (4 tip, 2" diameter, flat mill blade) and a nitrogen blanket applied at 100 cc/min. The oil solution is heated to 75° C. in 45 minutes, held at 75° C. for 45 minutes, and cooled to 60° C. in 75 minutes.

A second oil solution, consisting of 37.5 g Fragrance Oil, 0.5 g tertiarybutylaminoethyl methacrylate, 0.4 g 2-carboxyethyl acrylate, and 19.5 g Sartomer CN975 (hexafunctional aromatic urethane-acrylate oligomer) is added when the first oil solution reached 60° C. The combined oils are held at 60° C. for an additional 10 minutes.

Mixing is stopped and a water solution, consisting of 112 g 5% Celvol 540 polyvinyl alcohol, 200 g water, 1.1 g 20% NaOH, and 1.17 g DuPont Vazo-68WSP, is added to the bottom of the oil solution, using a funnel.

Mixing is again started, at 2500 rpm, for 60 minutes to emulsify the oil phase into the water solution. After milling is completed, mixing is continued with a 3" propeller at 350 rpm. The batch is held at 60° C. for 45 minutes, the temperature is increased to 75° C. in 30 minutes, held at 75° C. for 4 hours, heated to 90° C. in 30 minutes and held at 90° C. for 8 hours. The batch is then allowed to cool to room temperature.

The resulting encapsulates in the slurry have a median encapsulate size of about 5-20 microns. The encapsulates comprise about 10%, by weight of the encapsulates, of wall material, and about 90%, by weight of the encapsulates, of core material.

The slurry is modified with a cationic polysaccharide, which may be mixed into the slurry after the slurry has cooled down to room temperature. For example, a sufficient amount of polyquat-10 may be added to the batch to result in a modified slurry that comprises about 0.75%, or about 1%, or about 1.5%, or about 2% of polyquat-10, by weight of the modified slurry.

Example 2

Preparation of a Modified Encapsulate Slurry

A base encapsulate slurry, obtainable from Encapsys (Appleton, Wis.), is provided. The base slurry includes encapsulates that have an acrylamide-based shell surrounding a core. The core includes perfume raw materials. The shell includes polyvinyl alcohol that remains from the encapsulate-making process. The base slurry includes approximately 45%, by weight of the slurry, of encapsulates. The base slurry includes about 21%, by weight of the slurry, of total perfume (including encapsulated perfume). The base slurry includes a total of about 1% of polyvinyl alcohol (PVOH).

The base slurry is modified by adding a cationic polysaccharide, e.g. Polyquaternium-10. The composition is stirred for several minutes with a spatula to form a modified encapsulate slurry.

The slurry is put at a shaking table overnight to obtain complete mixing of the cationic polysaccharide in the slurry.

Example 3

Comparison of Base Slurry to Modified Slurry

A sample of the base slurry described in Example 2 are visually compared to a sample of the modified slurry (containing Polyquaternium-10) of Example 2.

After storage, the base slurry shows phase separation into two layers—a top opaque layer that appears white, and a cloudy bottom layer. It is believed that both layers include encapsulates.

After storage, the modified slurry shows phase separation into two layers—a top opaque layer that appears white, and a clear bottom layer. It is believed that the top layer includes the vast majority of the encapsulates, while the bottom layer is mostly water with very few encapsulates. Such phase separation may be advantageous as the layers can be easily separated by decanting, resulting in a composition with a more concentrated level of encapsulate. Such concentrated encapsulate compositions may be particularly useful for inclusion in final products that have low levels of water, such as solid compositions or non-aqueous compositions, such as those that may be encapsulated in water-soluble film to form a unitized dose article.

Example 4

Preparation of Finished Detergent Compositions

Two finished detergent compositions (Product A and Product B) were prepared as followed.

Two samples of a base detergent having the following formula is provided.

TABLE 1

| Base Detergent Ingredient | Part Weight % in final detergent product |
|---|---|
| HLAS | 2.1 |
| Amine Oxide | 0.5 |
| AES | 7.4 |
| Citric Acid | 1.1 |
| DTPA (chelant) | 0.3 |
| Borate derivative (sodium tetraborate) | 1.3 |
| Adjuncts (enzymes, polymers, etc.) | 8.3 |
| Water/Miscellaneous | 75.4 |

About 1.6 parts of an encapsulate slurry (as described below) is added to each base detergent, and about 2 parts of a structurant premix comprising hydrogenated castor oil is added as a final ingredient. The composition is mixed with an overhead mixer to form a finished detergent product.

Product A includes an unmodified encapsulate slurry as provided by the manufacturer (e.g., the base slurry described in Example 2). Product B includes a modified encapsulate slurry, where the slurry included 0.5%, by weight of the modified slurry, of cationic polysaccharide (Polyquaternium-10) (e.g., the modified slurry described in Example 2).

Products A and B are visually assessed for unacceptable levels of aggregation, and the results are provided in Table 2.

TABLE 2

| Product | Unacceptable aggregation? |
|---|---|
| Product A (incl. unmodified slurry) | Yes |
| Product B (incl. modified slurry) | No |

Example 5

Heavy Duty Liquid (HDL) Detergent Formulations

Exemplary, non-limiting formulations of heavy duty liquid (HDL) detergent formulations according to the present disclosure are provided below in Table 3.

TABLE 3

| Ingredient | HDL 1 | HDL 2 | HDL3 | HDL4 | HDL 5 | HDL 6 |
|---|---|---|---|---|---|---|
| Alkyl Ether Sulphate | 0.00 | 0.50 | 12.0 | 12.0 | 6.0 | 7.0 |
| Dodecyl Benzene Sulphonic Acid | 8.0 | 8.0 | 1.0 | 1.0 | 2.0 | 3.0 |
| Ethoxylated Alcohol | 8.0 | 6.0 | 5.0 | 7.0 | 5.0 | 3.0 |
| Citric Acid | 5.0 | 3.0 | 3.0 | 5.0 | 2.0 | 3.0 |
| Fatty Acid | 3.0 | 5.0 | 5.0 | 3.0 | 6.0 | 5.0 |
| Ethoxysulfated hexamethylene diamine quaternized | 1.9 | 1.2 | 1.5 | 2.0 | 1.0 | 1.0 |
| Diethylene triamine penta methylene phosphonic acid | 0.3 | 0.2 | 0.2 | 0.3 | 0.1 | 0.2 |
| Enzymes | 1.20 | 0.80 | 0 | 1.2 | 0 | 0.8 |
| Brightener (disulphonated diamino stilbene based FWA) | 0.14 | 0.09 | 0 | 0.14 | 0.01 | 0.09 |
| Cationic hydroxyethyl cellulose | 0 | 0 | 0.10 | 0 | 0.200 | 0.30 |
| Poly(acrylamide-co-diallyldimethylammonium chloride) | 0 | 0 | 0 | 0.50 | 0.10 | 0 |
| Hydrogenated Castor Oil Structurant | 0.50 | 0.44 | 0.2 | 0.2 | 0.3 | 0.3 |
| Boric acid | 2.4 | 1.5 | 1.0 | 2.4 | 1.0 | 1.5 |
| Ethanol | 0.50 | 1.0 | 2.0 | 2.0 | 1.0 | 1.0 |
| 1,2 propanediol | 2.0 | 3.0 | 1.0 | 1.0 | 0.01 | 0.01 |
| Glutaraldehyde | 0 | 0 | 19 ppm | 0 | 13 ppm | 0 |
| Diethyleneglycol (DEG) | 1.6 | 0 | 0 | 0 | 0 | 0 |
| 2,3-Methyl-1,3-propanediol (M pdiol) | 1.0 | 1.0 | 0 | 0 | 0 | 0 |
| Mono Ethanol Amine | 1.0 | 0.5 | 0 | 0 | 0 | 0 |
| NaOH Sufficient To Provide Formulation pH of: | pH 8 | pH 8 | pH 8 | pH 8 | pH 8 | pH 8 |
| Sodium Cumene Sulphonate (NaCS) | 2.00 | 0 | 0 | 0 | 0 | 0 |
| Silicone (PDMS) emulsion | 0.003 | 0.003 | 0.003 | 0.003 | 0.003 | 0.003 |
| Perfume | 0.7 | 0.5 | 0.8 | 0.8 | 0.6 | 0.6 |
| Polyethyleneimine | 0.01 | 0.10 | 0.00 | 0.10 | 0.20 | 0.05 |
| Perfume Encapsulates* | 1.00 | 5.00 | 1.00 | 2.00 | 0.10 | 0.80 |
| Water | Balance to 100% | Balance to 100% | Balance to 100% | Balance to 100% | Balance to 100% | Balance to 100% |

*Encapsulates are added as 25-35% active slurry (aqueous solution). Core/wall ratio can range from 80/20 up to 90/10 and average encapsulate diameter can range from 5 μm to 50 μm. The encapsulate walls include an acrylate polymer and PVOH. Slurry contains 0.5% cationic polysaccharide, by weight of the slurry.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of making a detergent composition, the method comprising the steps of:

a. providing a first composition comprising encapsulates and a second composition, wherein the encapsulates comprise a polyvinyl alcohol polymer;

wherein the first composition is an encapsulate slurry comprising from about 10% to about 60%, by weight of the first composition, of encapsulates and from about 0.1% to about 10% by weight of the first composition, of a cationic polysaccharide, wherein the encapsulates comprise a core and a shell at least partially surrounding the core, wherein the core comprises a benefit agent, and wherein the shell comprises at least a portion of the polyvinyl alcohol polymer;

wherein the second composition comprises a borate compound; and b. combining the first composition and the second composition to form a product composition.

2. A method according to claim 1, wherein the benefit agent of the core comprises perfume raw materials.

3. A method according to claim 1, wherein the shell comprises a shell material selected from the group consisting of polyethylenes; polyamides; polystyrenes; polyisoprenes; polycarbonates; polyesters; polyacrylates; acrylics; aminoplasts; polyolefins; polysaccharides; gelatin; shellac; epoxy resins; vinyl polymers; water insoluble inorganics; silicone; and mixtures thereof.

4. A method according to claim 1, wherein the shell comprises a shell material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

5. A method according to claim 1, wherein the shell comprises a polyacrylate.

6. A method according to claim 1, wherein the borate compound is selected from the group consisting of boric acid, boric acid derivatives, and combinations thereof.

7. A method according to claim 1, wherein the borate compound is present in the product composition at a level of about 0.1 wt % to about 10 wt %, by weight of the product composition.

8. A method according to claim 1, wherein the second composition further comprises a cationic polysaccharide.

9. A method according to claim 1, wherein the cationic polysaccharide is a cationic cellulose derivative.

10. A method according to claim 1, wherein the cationic cellulose derivative is selected from the group consisting of cationic hydroxyethylcellulose, cationic hydroxypropylcellulose, and mixtures thereof.

11. A method according to claim 10, wherein the cationic hydroxyethylcellulose comprises hydroxyethyl cellulose derivatized with trimethyl ammonium substituted epoxide.

12. A method according to claim 1, wherein the cationic polysaccharide is characterized by a weight average molecular weight of from greater than 100,000 to 2,000,000.

13. A method according to claim 1, wherein the product composition comprises from about 0.01 wt % to about 5 wt % of the encapsulates.

14. A method according to claim 1, wherein the product composition comprises from about 5 wt % to about 60 wt % of surfactant.

15. A method according to claim 1, wherein the product composition comprises no more than 5 encapsulates per gram of product composition, as determined by the Method for Determining Number of Particles ("AN212 Method").

16. A method according to claim 1, wherein either the first composition or the second composition is a base detergent comprising from about 5 wt % to about 75 wt % of a surfactant system.

* * * * *